US006398209B1

(12) United States Patent
Sato

(10) Patent No.: US 6,398,209 B1
(45) Date of Patent: Jun. 4, 2002

(54) SHEET SUPPLY APPARATUS

(75) Inventor: Shiro Sato, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/576,385

(22) Filed: May 22, 2000

(30) Foreign Application Priority Data

May 26, 1999 (JP) ..... 11-146696

(51) Int. Cl.[7] ..... B65H 3/32
(52) U.S. Cl. ..... 271/124
(58) Field of Search ..... 271/124, 167, 271/104, 136

(56) References Cited

U.S. PATENT DOCUMENTS 4,978,115 A * 3/1978 Sato et al. ..... 271/124
4,674,737 A * 6/1987 Murayoshi ..... 271/124
4,844,437 A * 7/1989 Tanaka et al. ..... 271/124
5,823,524 A * 10/1998 Kawada ..... 271/124

FOREIGN PATENT DOCUMENTS

FR 2 588 537 A1 * 10/1985 ..... B65H/3/52

* cited by examiner

*Primary Examiner*—Christopher P. Ellis
*Assistant Examiner*—Kenneth W. Bower
(74) *Attorney, Agent, or Firm*—Kanesaka & Takeuchi

(57) ABSTRACT

A sheet supply apparatus includes a sheet supply member for supplying printing sheets, a separating member movably situated adjacent to the sheet supply member, a pressing member movably situated adjacent to the separating member, an urging device disposed near the pressing member for urging the pressing member toward the separating member so that the separating member contacts the sheet supply member, and an adjusting device connected to the urging device for adjusting an urging force exerted on the pressing member by the urging device. The adjusting device includes a rotationally operating portion and a rotationally adjusting portion connected to the rotationally operating portion. The rotationally adjusting portion is situated adjacent to the pressing member and the urging member to adjust the urging force while being operated by the rotationally operating portion.

5 Claims, 10 Drawing Sheets

SHEET SUPPLY APPARATUS

BACKGROUND OF THE INVENTION

1. Field of the Invention

The present invention relates to a sheet supply apparatus of a so-called frictional separating method type. The sheet supply apparatus of such type can separate a sheet from sheets stacked therein by utilizing friction between a sheet supply roller and a separating plate.

2. Description of the Related Art

A sheet supply apparatus is such a machine that separates and feeds out stacked sheets one by one. Such sheet supply apparatus is usually installed in a printing machine, for example.

FIGS. 8 to 10 illustrate one example of such conventional sheet supply apparatus.

The sheet supply apparatus includes a sheet supply roller 1 and a separating base 2. The sheet supply roller 1, a separating member, is situated to a predetermined position and driven to rotate. The separating base 2, a separating member, is situated below the sheet supply roller 1.

The sheet supply roller 1 includes a core 3 and a roller member 4 integrally connected to an outer circumferential surface of the core 3. The core 3 is connected to a sheet supply shaft 5. The sheet supply shaft 5 is connected to a not-shown drive shaft.

The separating base 2 includes a high-friction member 6 and a curved stainless plate member 7 situated to a sheet-entrance side of the base. The sheet supply roller 1 contacts the high-friction member 6 of the separating base 2. Sheets fed thereto are separated from each other so that only one of the sheets can be conveyed forward.

A supporting plate 8 is fixed to a predetermined position. A lever 10 is pivotally movably attached to the supporting plate 8 by a support screw 9. The separating base 2 is attached to the lever 10 by a pin 11 so as to rotate around the pin. The separating base 2 can be detached from the pin 11. The supporting plate 8 has an attachment plate 12 integrally formed therewith. Through holes 8*a* and 12*a* are formed in a bottom of the supporting plate 8 and the attachment plate 12, respectively. A pressing pole 13 as a pressing member is inserted through the through holes 8*a* and 12*a*. The pressing pole 13 can move vertically along an axial direction of itself. A flange 14 is attached to the pressing pole 13 between the bottom of the supporting plate 8 and the attachment plate 12. An adjusting plate 15 as adjusting means is slidably situated on an upper surface of the bottom of the supporting plate 8. The adjusting plate 15 is longitudinal in a sliding direction of itself and narrow in a width direction. A slit 16 is formed in the adjusting plate 15 along the longitudinal direction thereof. The pressing pole 13 is inserted through the slit. An operating surface 17 is formed on both sides of the slit 16 on an upper surface of the adjusting plate 15. A height of the operating surface 17, i.e. a thickness of the adjusting plate 15, changes gradually along the longitudinal direction of the adjusting plate 15. One end portion of the adjusting plate 15 is designated as an operating end 18 and situated inside a casing of the present sheet supply apparatus. And, a spring 19 as urging means is disposed around the pressing pole 13 between the flange 14 and the adjusting plate 15.

In the constitution explained above, sheets are rubbed between the sheet supply roller 1 and the separating base 2, and conveyed forward by the sheet supply roller 1. When a plurality of the sheets reaches the separating base 2 while stacking with each other, the sheets are separated by the sheet supply roller 1 and the separating base 2 so that only one sheet can be conveyed forward. Here, the order $F_A$. $F_C$. $F_B$ is preferable where $F_A$ is a frictional force exerted between the sheet supply roller 1 and the printing sheet, $F_B$ is a frictional force exerted among the printing sheets, and $F_C$ is a frictional force exerted between the printing sheet and the separating base 2.

If difference among the frictional forces is not sufficient, the printing sheet may not be conveyed, or a plurality of the printing sheets is conveyed while not being separated from each other. The former phenomenon is called "conveyance failure", and the latter "multiple conveyance".

The adjusting means explained above is used to properly arrange the difference among the frictional forces. The surface of the printing sheet is rough because it is composed of intertwined fibers. When the sheet supply roller 1 of a soft material is pressed against the printing sheet so that a nip width in which the printing sheet is held is enlarged, the frictional force between the sheet supply roller 1 and the printing sheet is enlarged and stabilized. If the nip width is small, the frictional force tends to decrease due to surface abrasion of the sheet supply roller 1 and paper powder generated from the printing sheets. Since many types of the printing sheets are in use, the frictional force among the sheets is varied accordingly. Therefore, stable conveyance of the printing sheet of many types inevitably requires the above-explained adjusting means for adjusting separating pressure. The separating pressure is to be adjusted by users so as to conform to a type of the sheet to be used.

In the constitution explained above, the pressing pole 13 is elastically urged upward by the spring 19 relative to the supporting plate 8. A top end of the pressing pole 13 presses up the lever 10. The separating base 2 attached to the lever 10 is urged upward to contact the sheet supply roller 1.

The separating pressure exerted on the sheet supply roller 1 by the separating base 2 can be adjusted by operating the adjusting plate 15. A user is to detach a part of a casing of the present apparatus to expose the operating end 18. The user is to take the operating end 18 and pull the adjusting plate 15 to slide along the longitudinal direction thereof. When the adjusting plate 15 thus slides, the height of the operating surface 17 of the adjusting plate 15 is changed at a position where the spring 19 is disposed. FIGS. 8 and 10 show that the spring 19 is supported by a relatively low operating surface 17, which means the separating pressure is small. FIG. 9 shows that the spring 19 is supported by a relatively high operating surface 17, which means the separating pressure is large.

After the adjustment is finished, the part is attached to the casing, and then the sheet supply apparatus is actually operated to feed the printing sheets, so that effect of adjusting the separating pressure is confirmed. If no effect is confirmed, the part of the casing is again detached and the adjustment is conducted once more.

In the conventional sheet supply apparatus as stated above, elastic force of the spring 19 is changed by sliding the adjusting plate 15. Accordingly, the adjusting plate 15 is required to be made in a longitudinal form along the sliding direction. Additionally, any other parts or members can not be allowed to be placed in a space where the adjusting plate 15 slides so as to prevent interference therewith. Thus, in the conventional sheet supply apparatus, an inside space thereof is not utilized effectively.

In the conventional sheet supply apparatus, the slidable adjusting plate 15 is downsized to its limit so as to utilize any of the inside space. Accordingly, the operating end 18 of the adjusting plate 15 must be placed inside the apparatus. This means that the operating end 18 cannot project out the apparatus. Therefore, when adjustment of the separating pressure is needed, the casing must be opened by detaching the part therefrom.

In the conventional sheet supply apparatus, since the longitudinal adjusting plate 15 slides along the longitudinal direction thereof, a groove 8*b* must be formed in the supporting plate 8 for guiding the adjusting plate 15 to slide therein. This groove 8*b* deteriorates strength of the supporting plate 8.

This invention is made to solve the problems as explained above. An object of the present invention is to provide a sheet supply apparatus which is enough compact to be situated in a small space and can be easily operated from the outside thereof.

SUMMARY OF THE INVENTION

According to a first aspect of the present invention, there is provided a sheet supply apparatus comprising a sheet supply member for supplying printing sheets; a separating member movably situated adjacent to the sheet supply member; a pressing member movably situated adjacent to the separating member; an urging device disposed near the pressing member for urging the pressing member toward the separating member so that the separating member contacts the sheet supply member;, and an adjusting device connected to the urging device for adjusting an urging force exerted on the pressing member by the urging device, the adjusting device including a rotationally operating portion and a rotationally adjusting portion connected to the rotationally operating portion, the rotationally adjusting portion being situated adjacent to the pressing member and the urging member and adjusting the urging force while being operated by the rotationally operating portion.

According to a second aspect of the present invention, there is provided a sheet supply apparatus comprising a sheet supply roller for supplying printing sheets; a separating member pivotally movably situated adjacent to the sheet supply roller; a pressing member movably situated adjacent to the separating member for pressing the separating member toward the sheet supply roller; an operating portion pivotally movably situated adjacent to the pressing member; an urging device situated between the pressing member and the operating portion, the urging device urging the pressing member toward the separating member; rotationally adjusting portion cooperating with the operating portion, the rotationally adjusting portion moving the operating portion while being rotated so that an urging force exerted on the separating member by the urging device through the pressing member is adjusted; and a rotationally operating portion connected to the rotationally adjusting portion for rotating the rotationally adjusting portion.

According to a third aspect of the present invention, there is provided a sheet supply apparatus comprising a sheet supply roller for supplying printing sheets; a separating member pivotally movably situated adjacent to the sheet supply roller; a pressing member movably situated adjacent to the separating member for pressing the separating member toward the sheet supply roller; a cam rotatably situated adjacent to the pressing member; an urging device situated between the pressing member and the cam, the urging device urging the pressing member toward the separating member; and a rotationally operating portion connected to the cam for rotating the cam so that an urging force exerted on the separating member by the urging device through the pressing member is adjusted.

A sheet supply apparatus as defined in a fourth aspect of the present invention, in the second aspect of the present invention, further comprises a case containing the sheet supply roller and the separating member therein, and the rotationally operating portion is operated from an outside of the case.

A sheet supply apparatus as defined in a fifth aspect of the present invention, in the second aspect of the present invention, further comprises a fixing device situated at the rotationally operating portion, and the fixing means fixes the rotationally operating portion to an optional position in a rotational direction thereof.

A sheet supply apparatus as defined in a sixth aspect of the present invention, in the third aspect of the present invention, further comprises a case containing the sheet supply roller and the separating member therein, and the rotationally operating portion is operated from an outside of the case.

A sheet supply apparatus as defined in a seventh aspect of the present invention, in the third aspect of the present invention, further comprises a fixing device situated at the rotationally operating portion, and the fixing device fixes the rotationally operating portion to an optional position in a rotational direction thereof.

DETAILED DESCRIPTION

Figure 1:
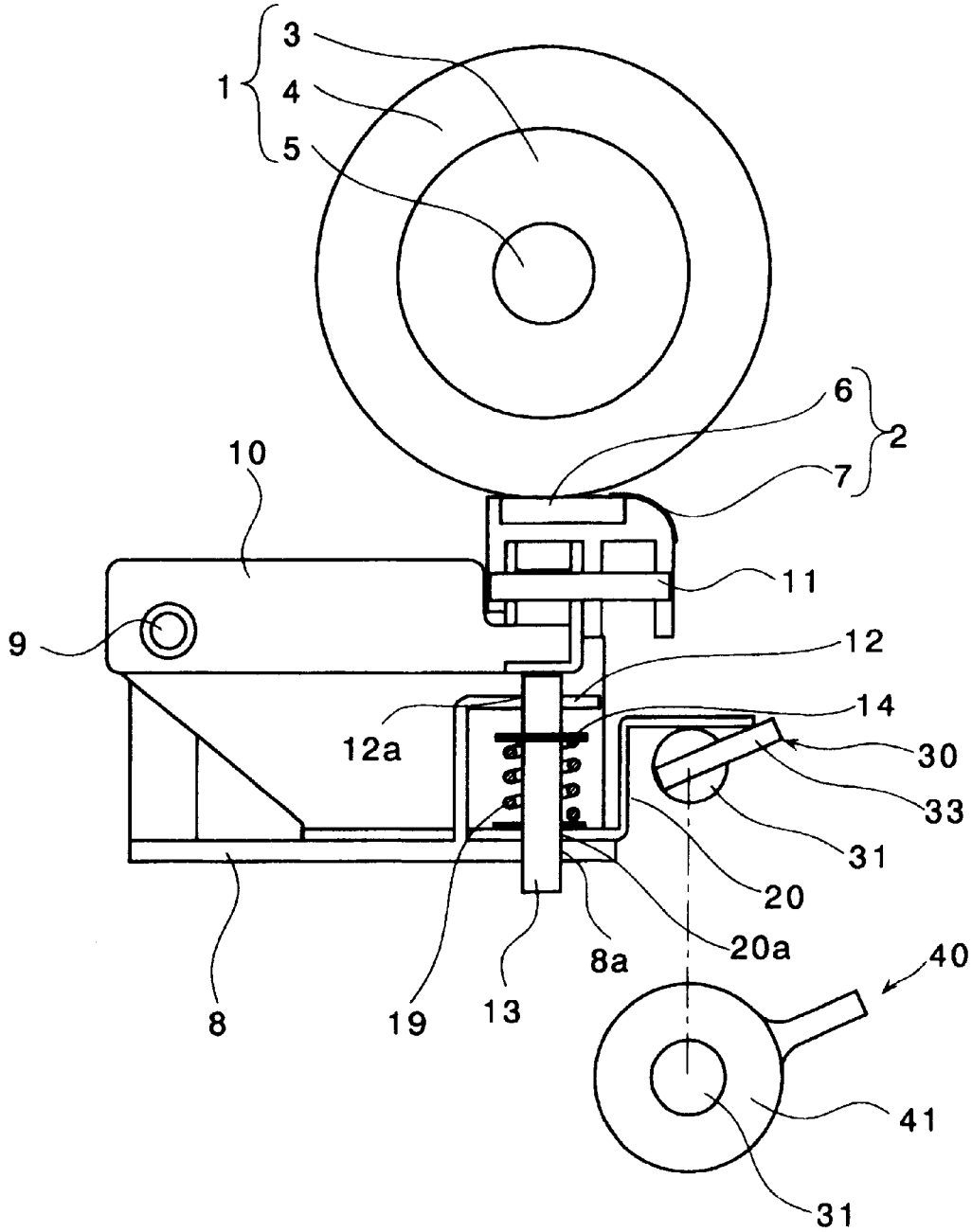
FIG. 1 is a side view, partially sectioned, of a first embodiment in a condition where a separating pressure is small.
Figure 2:
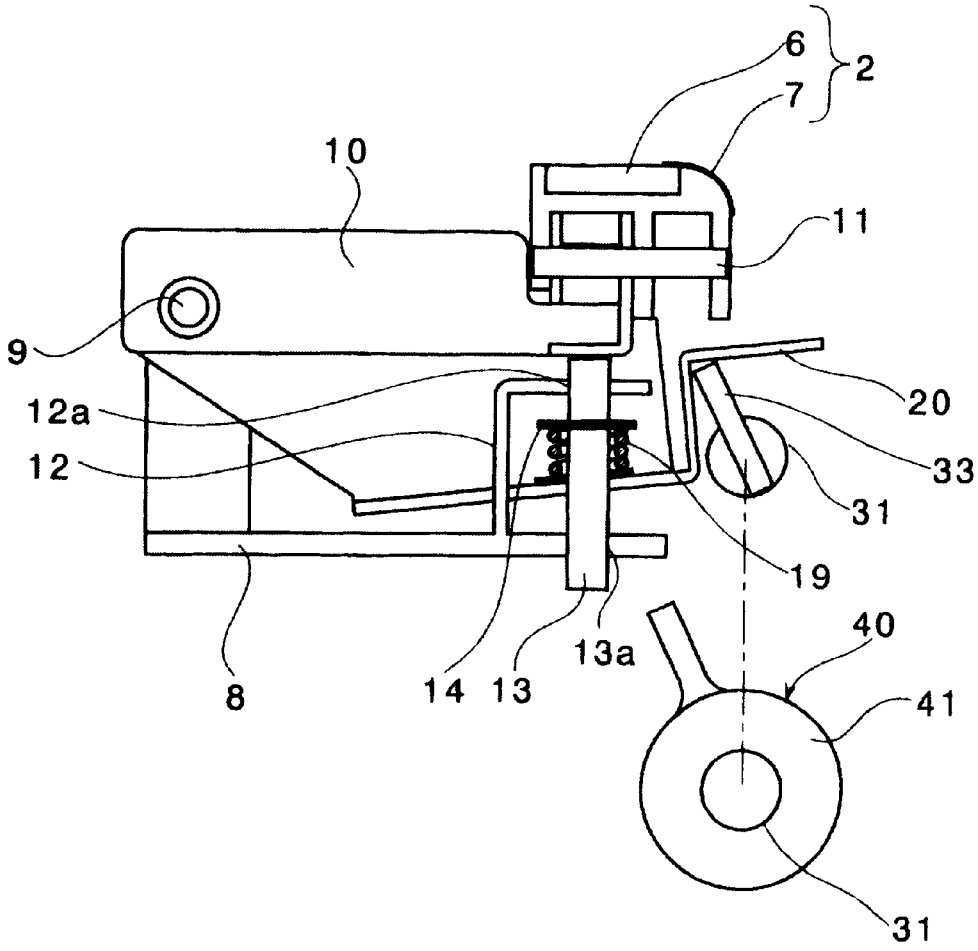
FIG. 2 is a side view, partially sectioned, of the first embodiment in a condition where the separating pressure is large.
Figure 3:
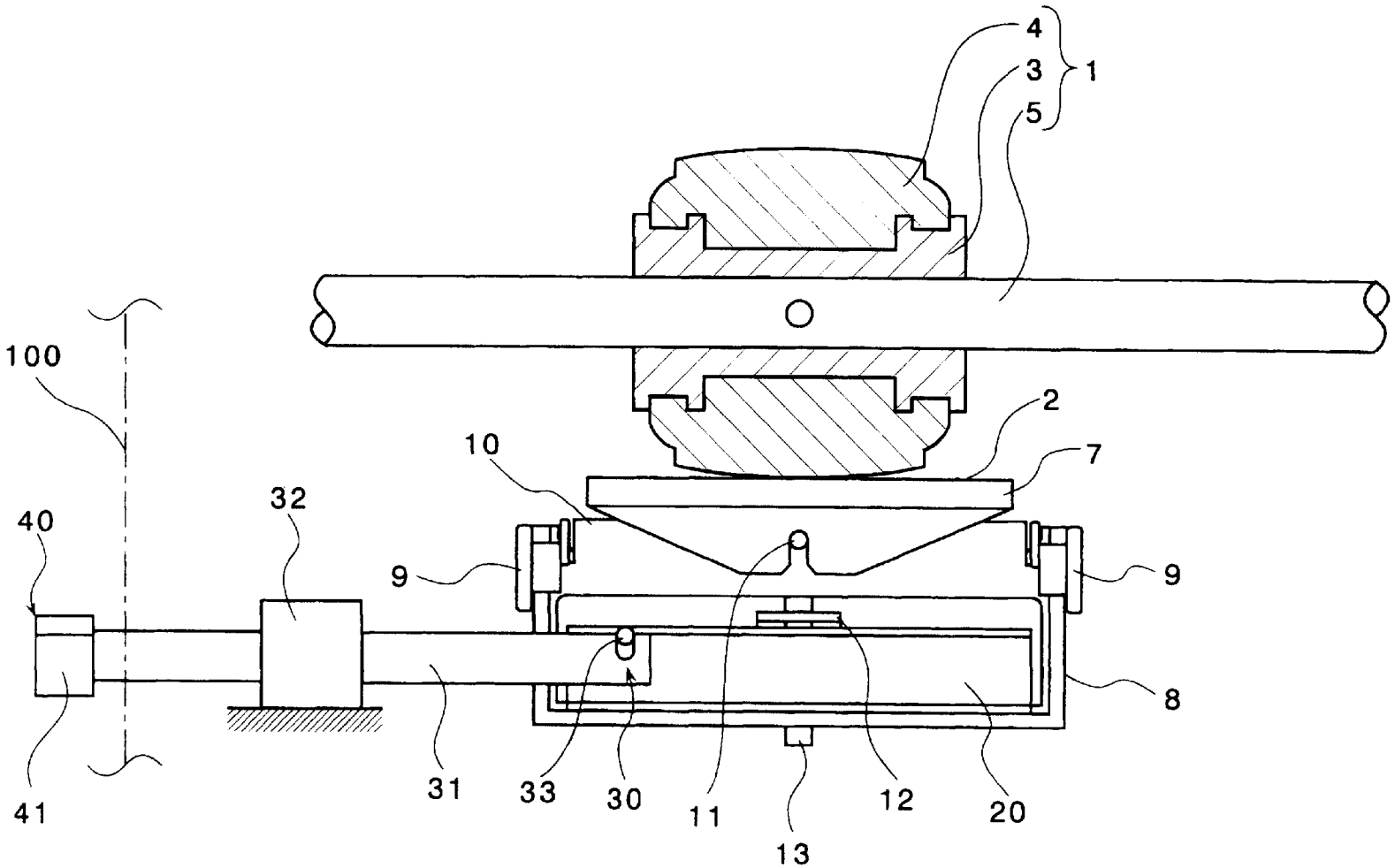
FIG. 3 is an elevation view, partially sectioned, of the first embodiment in a condition where the separating pressure is small.

FIGS. 1 to 3 show a first embodiment of a sheet supply apparatus of the present invention.

The sheet supply apparatus includes a sheet supply roller 1 situated to a predetermined position as a sheet supply member and a separating base 2 situated below the sheet supply roller 1 as a separating member. The separating base 2 has a high-friction member 6 and a curved stainless plate member 7 situated to an entrance side of a printing sheet. The sheet supply roller 1 contacts the high-friction member 6 of the separating base 2. Sheets fed thereto are separated from each other so that only one of the sheets can be conveyed forward.

The sheet supply roller 1 includes a core 3 and a roller member 4 integrally connected to an outer circumferential surface of the core 3. The core 3 is connected to a sheet supply shaft 5. The sheet supply shaft 5 is connected to a not-shown drive shaft.

A supporting plate 8 is fixed to a predetermined position. A lever 10 is pivotally movably attached to the supporting plate 8 by a support screw 9. The separating base 2 is attached to the lever 10 by a pin 11 so as to be rotationally movable around the pin 11. The separating base 2 can be detached from the pin 11. The supporting plate 8 has an attachment plate 12 integrally formed therewith. An operating plate 20 as an operating portion is attached to the supporting plate 8 by the support screw 9. A forward end portion of the operating plate 20 protrudes over each of forward end portions of the supporting plate 8 and the separating base 2. The operating plate 20 and the separating base 2 are rotationally movable relative to the supporting plate 8 in an independent manner with each other.

Through holes 8*a,* 20*a,* and 12*a* are formed in a bottom of the supporting plate 8, a forward portion of the operating plate 20, and the attachment plate 12, respectively. A pressing pole 13 as a pressing member is inserted through the through holes 8*a,* 20*a,* and 12*a*. The pressing pole 13 can move axially vertically. A flange 14 is attached to an upper portion of the pressing pole 13 between the operating plate 20 and the attachment plate 12. And, a spring 19 as urging means is fitted on the pressing pole 13 between the flange 14 and the operating plate 20. The spring 19 urges the pressing pole 13 toward the separating base 2.

The sheet supply apparatus includes adjusting means for adjusting the urging force of the spring 19. The adjusting means includes a rotationally adjusting portion 30 for pivotally moving the operating plate 20 and a rotationally operating portion 40 for operating the rotationally adjusting portion 30. The rotationally adjusting portion 30 has an adjusting shaft 31. The adjusting shaft 31 is supported by a bearing 32 situated to a predetermined position in a case 100. The bearing 32 applies appropriate rotational resistance to the adjusting shaft 31 so that the adjusting shaft 31 can be optionally positioned in a rotational direction. A pin 33 is attached to a circumferential surface of one end of the adjusting shaft 31. The pin 33 can contact the operating plate 20. Accordingly, if the adjusting shaft 31 is rotated, the pin 33 moves the operating plate 20. The other end of the adjusting shaft 31 protrudes outside the case 100 of the apparatus. To the protruding end of the shaft, an adjusting knob 41 is attached as the rotationally operating portion.

According to the constitution explained above, the pressing pole 13 is urged upward relative to the supporting plate 8 by elasticity of the spring 19. The top end of the pressing pole 13 pushes up the lever 10. The separating base 2 attached to the lever 10 is urged upward to contact the sheet supply roller 1.

To adjust the separating pressure acting between the sheet supply roller 1 and the separating base 2 contacted therewith, the adjusting knob 41 is rotated. Hence, the adjusting shaft 31 is rotated so that the pin 33 turns, thereby moving the operating plate 20. In this way, the height of the operating plate 20 on which the spring 19 is supported is adjusted. FIGS. 1 and 3 illustrate a condition where the operating plate 20 is positioned low and the separating pressure is small. FIG. 2 illustrates a condition where the operating plate 20 is positioned high and the separating pressure is large.

After adjustment, the sheet supply apparatus is operated to feed printing sheets actually, so that whether the adjustment of the separating pressure is satisfactory can be confirmed. If not, the adjusting knob 41 can be operated outside the apparatus. It is not necessary to detach a part of the case and operate the inside mechanism.

According to the present embodiment, the separating pressure acting between the sheet supply roller 1 and the separating base 2 is determined by the urging force of the pressing pole 13, and the urging force is adjusted by the operating plate 20 moved by the pin 33 of the rotating adjusting shaft 31. Therefore, in comparison with the conventional adjustment mechanism with the sliding longitudinal cam plate, the adjusting means of the present embodiment occupies smaller space inside the apparatus. Additionally, operation of the present apparatus is convenient since it can be conducted from outside of the case 100 by the adjusting knob 41.

FIGS. 4 to 7 illustrate a second embodiment of the sheet supply apparatus of the present invention.

This sheet supply apparatus has adjusting means structurally different from that of the first embodiment. Substantially the same portions as that of the first embodiment will be referred to by the reference numerals of FIGS. 1 to 3, and explanation thereof may be omitted.

The adjusting means of the present embodiment includes a cam 50 of a disc-form as the rotationally adjusting portion for adjusting the urging force of the spring 19. A supporting shaft 51 is formed on the upper surface of the supporting plate 8. The supporting shaft 51 is inserted into a supporting hole formed in the center of the cam 50 so that the cam 50 can rotate relative to the supporting plate 8. The cam 50 has a groove 52 circumferentially formed in an upper surface thereof. And, an operating surface 53 is formed on the upper surface of the cam 50 along the groove 52 for operating the pressing pole 13. The height of the operating surface 53, a thickness of the cam 50, changes gradually along the circumferential direction of the cam.

The pressing pole 13 is inserted through the groove 52. The pressing pole 13 is axially vertically movable. A flange 14 is attached to an upper portion of the pressing pole 13 between the cam 50 and the attachment plate 12. And, a spring 19 as urging means is fitted on the pressing pole 13 between the flange 14 and the cam 50. A washer 54 as receiving means is situated between the lower end of the spring 19 and the cam 50. The spring 19 urges the pressing pole 13 toward the separating base 2 relative to the supporting plate 8. When the cam 50 rotates, the operating surface 53 of the cam 50 moves up and down, thereby changing a force of the spring 19 that urges the pressing pole 13 upward.

An outer circumferential surface of the cam 50 is formed as a warm wheel 55. The warm wheel 55 engages a warm 56. The warm 56 is attached to one end of a warm shaft 57. The warm shaft 57 is rotatably supported by a not-shown bearing and protruding outside the case 100. To the other end of the warm shaft 57 outside the case 100, an adjusting knob 60 as the rotationally operating portion is attached. Rotation of the adjusting knob 60 makes the cam 50 to rotate.

In the constitution as stated above, the pressing pole 13 is urged upward relative to the supporting plate 8 by an elastic force of the spring 19. The top of the pressing pole 13 pushes up the lever 10. The separating base 2 attached to the lever 10 is urged upward to contact the sheet supplying roller 1.

Figure 4:
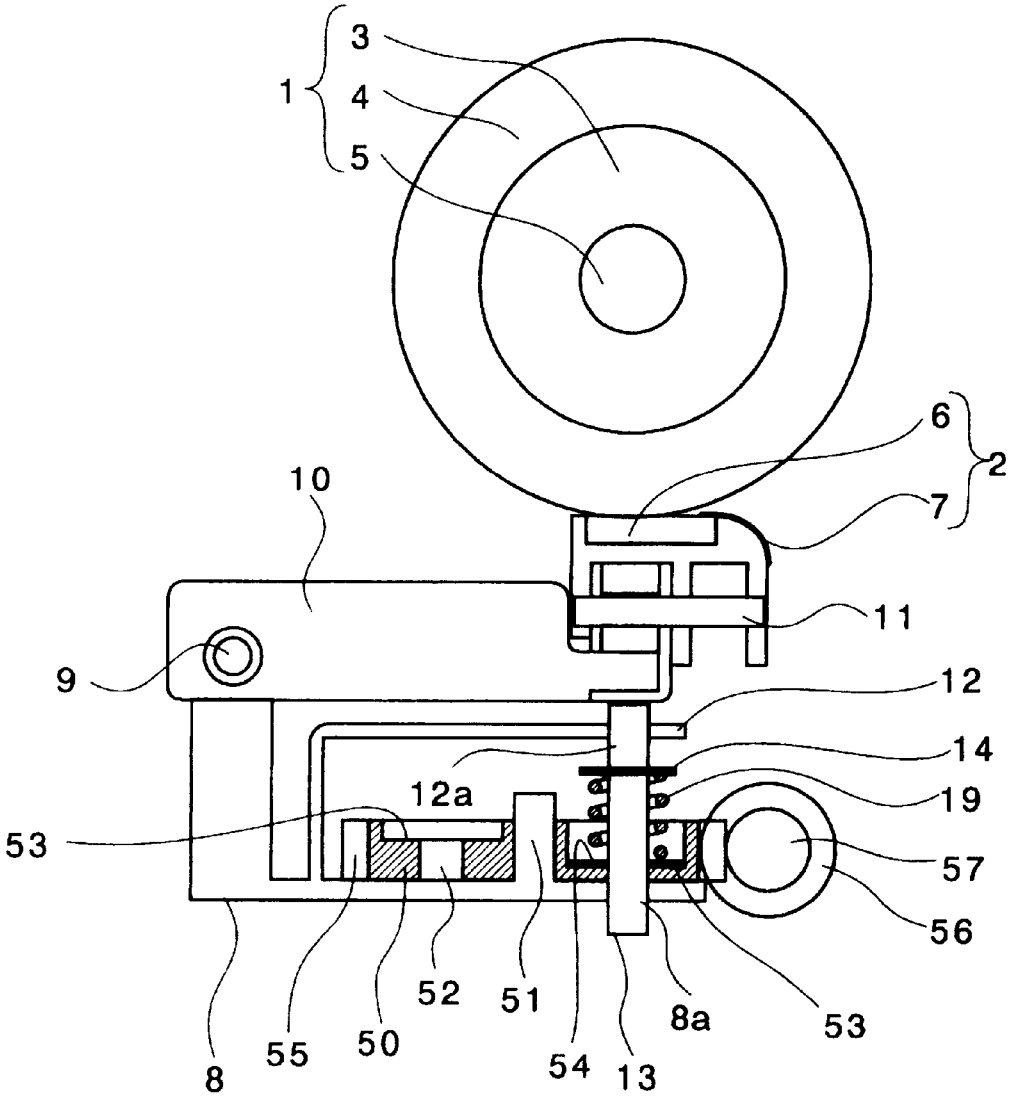
FIG. 4 is a side view, partially sectioned, of a second embodiment in a condition where a separating pressure is small.
Figure 5:
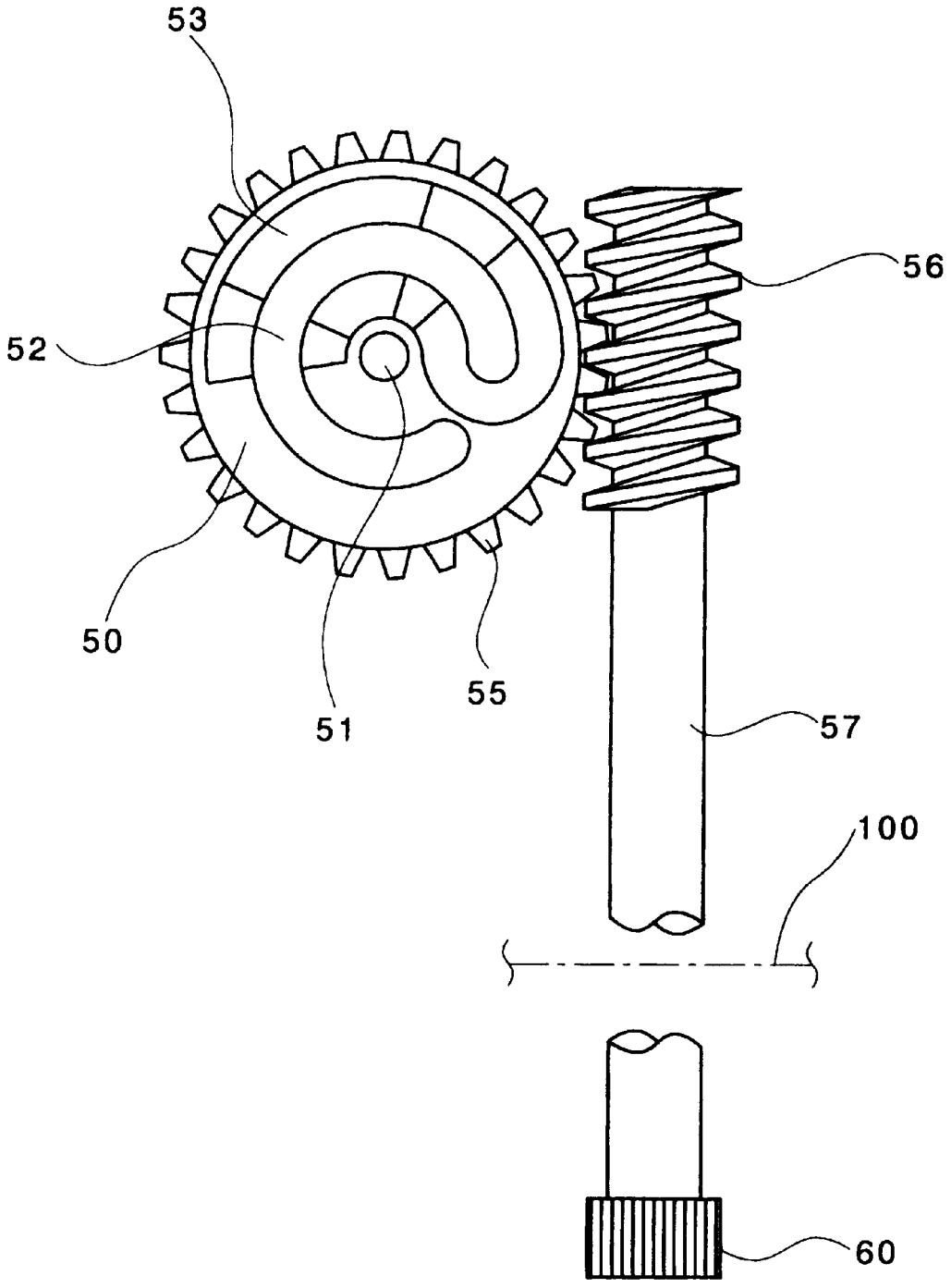
FIG. 5 is a plan view of adjusting means of the second embodiment.
Figure 6:
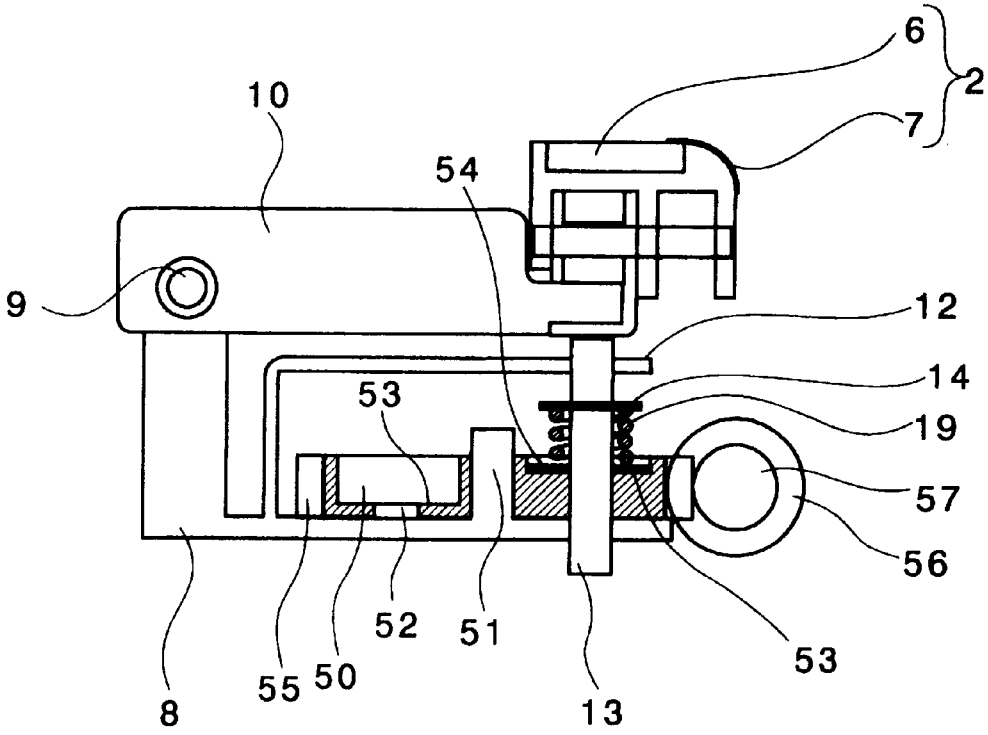
FIG. 6 is a side view, partially sectioned, of the second embodiment in a condition where the separating pressure is large.
Figure 7:
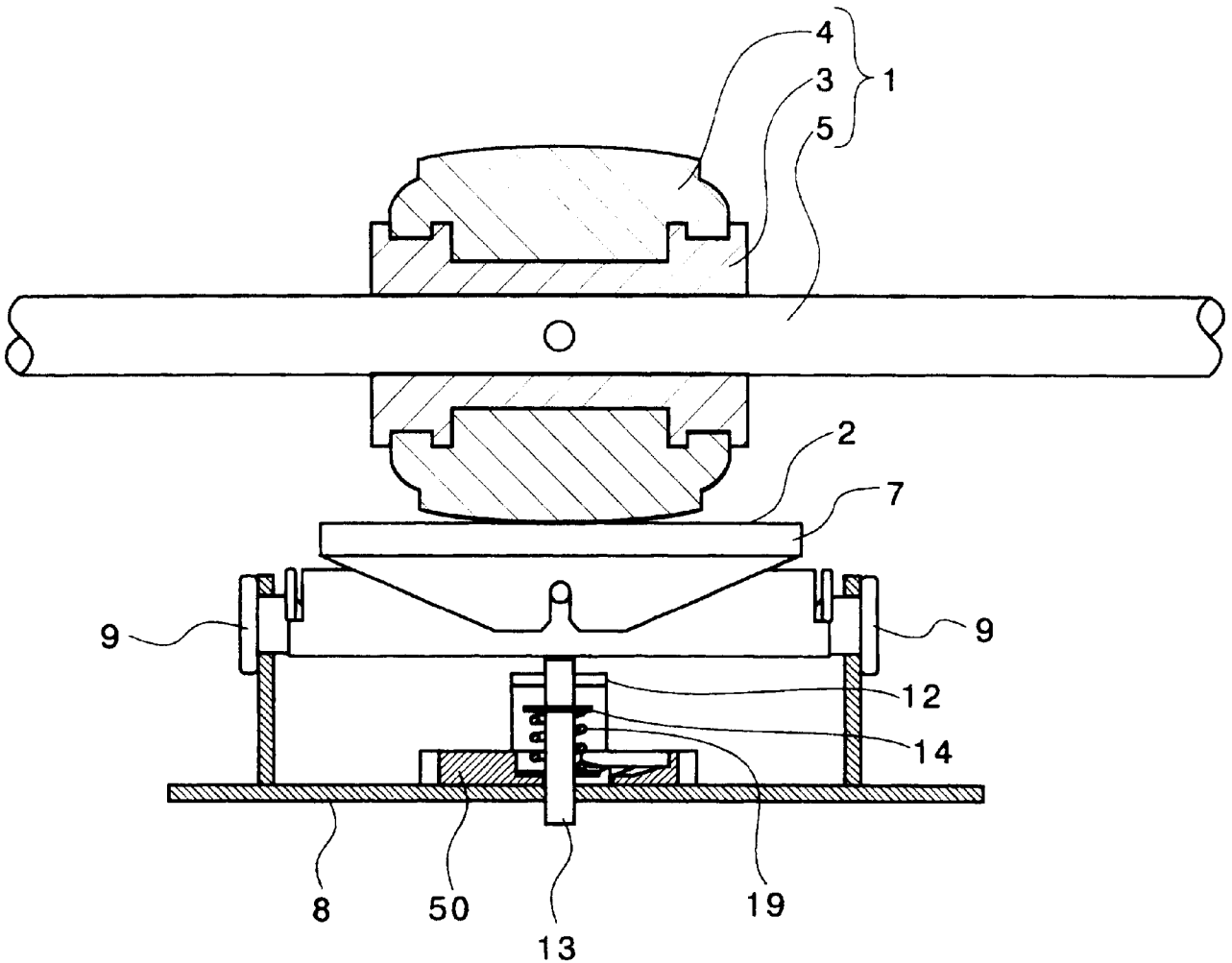
FIG. 7 is an elevation view, partially sectioned, of the second embodiment in a condition where the separating pressure is small.
Figure 8:
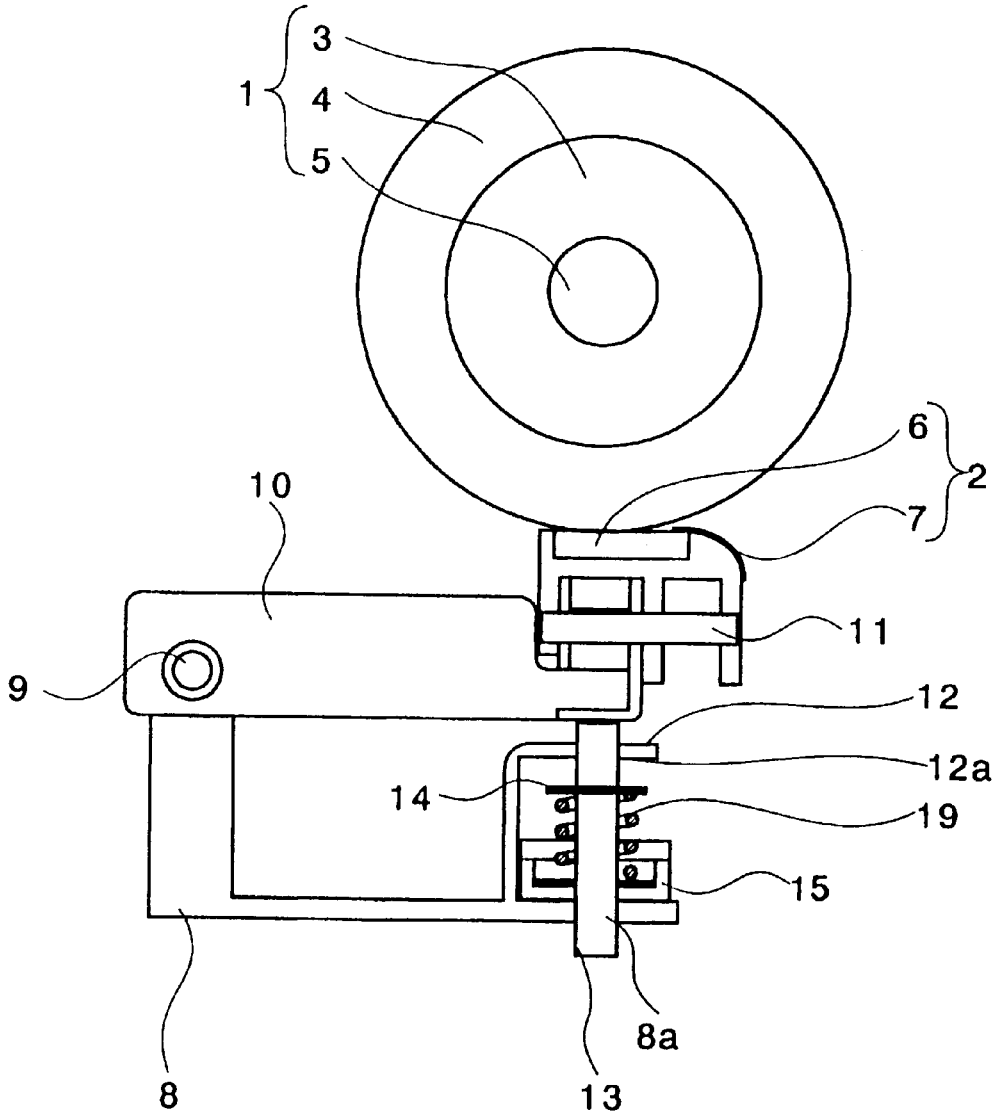
FIG. 8 Prior Art
FIG. 8 is a side view, partially sectioned, of a conventional sheet supply apparatus in a condition where a separating pressure is small.
Figure 9:
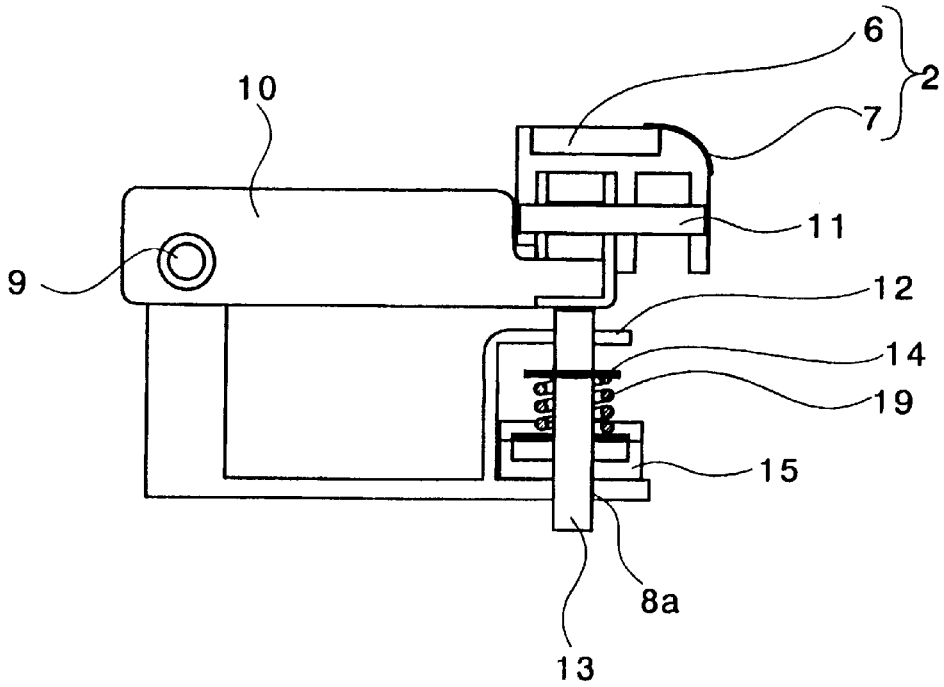
FIG. 9 Prior Art
FIG. 9 is a side view, partially sectioned, of a conventional sheet supply apparatus in a condition where a separating pressure is large.
Figure 10:
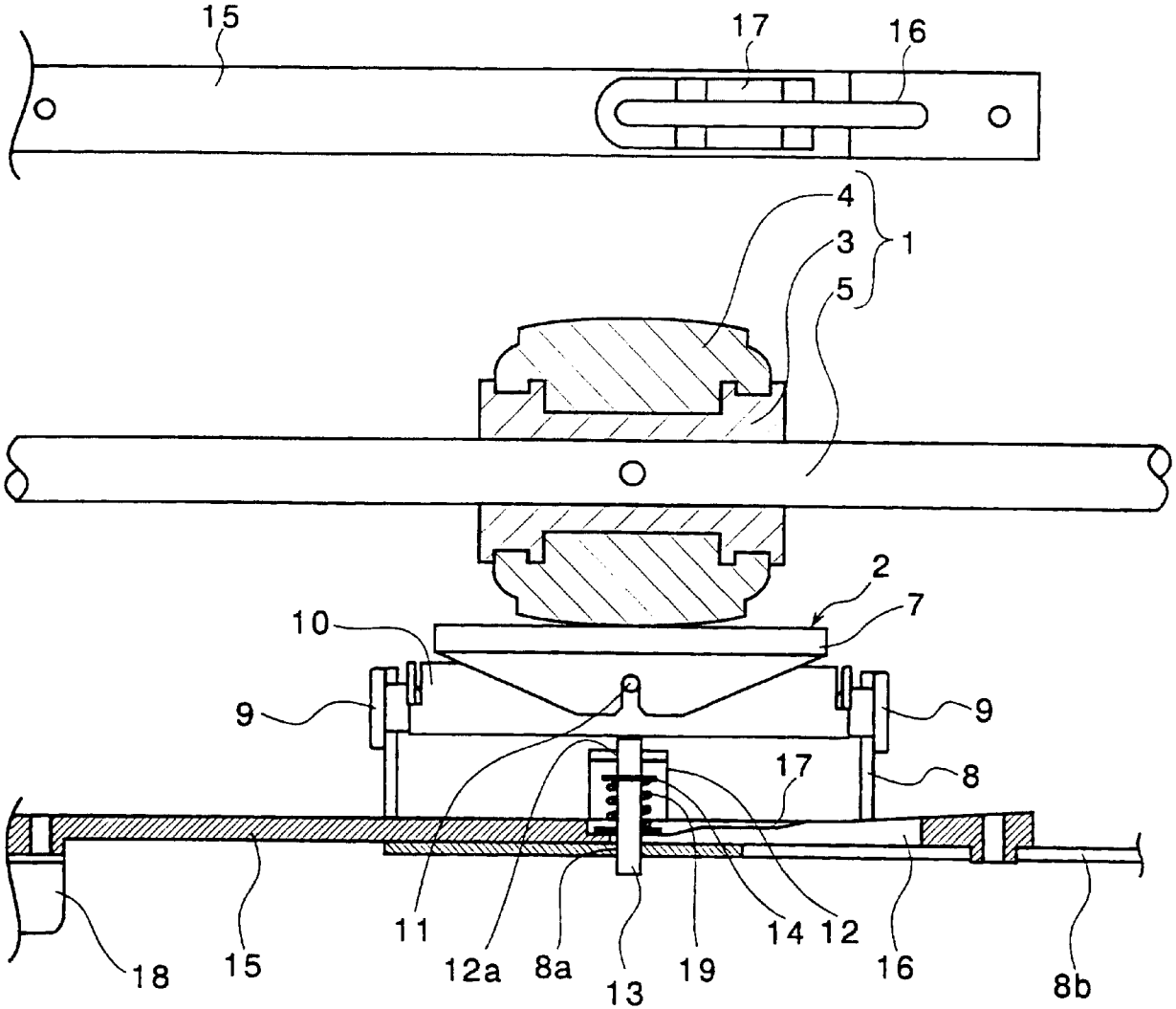
FIG. 10 Prior Art
FIG. 10 is a combination of an elevation view, partially sectioned, of a conventional sheet supply apparatus in a condition where a separating pressure is small and a plan view of adjusting means.

To adjust the separating pressure acting between the sheet supply roller 1 and the separating base 2 contacted therewith, the adjusting knob 60 situated outside the present apparatus is rotated. Hence, the warm shaft 57 is rotated so that the cam 50 turns, thereby adjusting the pressing force of the spring 19. FIGS. 4 and 7 illustrate a condition where the operating surface 53 for pressing the spring 19 is positioned low so that the pressing force of the spring 19 is adjusted to be small. This is the case where the separating pressure is adjusted to be small. FIG. 6 illustrates a condition where the operating surface 53 for pressing the spring 19 is positioned high so that the pressing force of the spring 19 is adjusted to be large. This is the case where the separating pressure is adjusted to be large.

After adjustment, the sheet supply apparatus is operated to feed printing sheets actually, so that whether the adjustment of the separating pressure is satisfactory can be confirmed. If not, the adjusting knob can be operated outside the apparatus. It is not necessary to detach a part of the case and operate the inside mechanism.

According to the present embodiment, the separating pressure acting between the sheet supply roller 1 and the separating base 2 is determined by the urging force of the pressing pole 13, and which force is adjusted by the rotating cam 50. Further, the cam 50 is rotated by the warm 56 and the warm wheel 55. Therefore, in comparison with the conventional adjustment mechanism with the sliding longitudinal cam plate, the adjusting means of the present embodiment occupies smaller space inside the apparatus. Additionally, the present apparatus is convenient in use since it can be operated from outside of the case 100 by the adjusting knob 60.

The sheet supply apparatus of the present invention as explained above can be applicable to various kinds of machines that need function of separating stacked sheets. For example, the invention can be applied to a printing machine or a gathering machine for feeding printed sheets into a plurality of bins.

According to the present invention, in a sheet supply apparatus in which printing sheets are separated by a sheet supply member and a separating member, a force urging the separating member to contact the sheet supply member is adjusted by a rotationally adjusting portion and a rotationally operating portion associated therewith. Therefore, the present invention facilitates more effective utilization of the space inside the apparatus in comparison with the conventional adjusting member of the sliding constitution. Additionally, operation is easy in the apparatus of the present invention since it can be conducted from the outside thereof Further, since it is not necessary to form a groove in a structural member of the apparatus for guiding the conventional adjusting member to slide therein, strength of the structural member does not deteriorate.

Thus, the present invention can provide the sheet supply apparatus that is enough compact to be situated in a small space and includes the separating pressure adjusting mechanism that is operable from the outside thereof.

What is claimed is:

1. A sheet supply apparatus comprising:

a sheet supply roller for supplying printing sheets;

a separating member pivotally movably situated adjacent to said sheet supply roller;

a pressing member movably situated situated adjacent to said separating member for pressing said separating member toward said sheet supply roller;

an operating portion pivotally movably situated adjacent to said pressing member;

urging means situated between said pressing member and said operating portion, said urging means urging said pressing member toward said separating member to allow the separating member to press the sheet supply roller;

a rotationally adjusting portion cooperating with said operating portion, said rotationally adjusting portion including an adjusting shaft rotatably situated without moving in an axial direction thereof, and a pin attached to an outer surface of the adjusting shaft to project therefrom and contacting the operating portion so that when the adjusting shaft is rotated, the pin is rotated to move the operating portion relative to the separating member to thereby change and adjust an urging force exerted on said separating member by said urging means through said pressing member; and a rotationally operating portion connected to said adjusting shaft for rotating said adjusting shaft.

2. A sheet supply apparatus according to claim 1, further comprising a case containing said sheet supply roller and said separating member therein, said rotationally operating portion being operated from an outside of said case.

3. A sheet supply apparatus according to claim 1, further comprising fixing means situated at said rotationally operating portion, said fixing means fixing said rotationally operating portion to an optional position in a rotational direction thereof.

4. A sheet supply apparatus according to claim 1, wherein said separating member is located under the sheet supply roller and is movable relative to an axis perpendicular to an axis of the sheet supply roller, and said pressing member is an elongated member to be movable along a longitudinal direction thereof and contacting a lower surface of the separating member.

5. A sheet supply apparatus according to claim 1, wherein said adjusting shaft is located under the operating portion, and said urging means is a spring so that when the adjusting shaft is rotated, the operating portion is moved to thereby adjust the urging force of the spring applied to the separating member.

* * * * *